US010211523B2

(12) United States Patent
Tishin et al.

(10) Patent No.: US 10,211,523 B2
(45) Date of Patent: Feb. 19, 2019

(54) LOW-FREQUENCY ANTENNA

(71) Applicants: Aleksandr Mettalinovich Tishin, Moscow (RU); Samed Veisalkara Halilov, Moscow (RU)

(72) Inventors: Aleksandr Mettalinovich Tishin, Moscow (RU); Samed Veisalkara Halilov, Moscow (RU)

(73) Assignee: Aleksandr Mettalinovich Tishin, Moscow (RU)

( * ) Notice: Subject to any disclaimer, the term of this patent is extended or adjusted under 35 U.S.C. 154(b) by 0 days.

(21) Appl. No.: 14/859,889

(22) Filed: Sep. 21, 2015

(65) Prior Publication Data

US 2016/0013547 A1 Jan. 14, 2016

Related U.S. Application Data

(63) Continuation of application No. PCT/RU2014/000168, filed on Mar. 18, 2014.
(Continued)

(30) Foreign Application Priority Data

Mar. 20, 2013 (RU) ..... 2013112500

(51) Int. Cl.
*H01Q 1/40* (2006.01)
*H01Q 7/00* (2006.01)
(Continued)

(52) U.S. Cl.
CPC ..... *H01Q 1/40* (2013.01); *H01Q 7/00* (2013.01); *H01Q 21/06* (2013.01); *H01Q 1/38* (2013.01)

(58) Field of Classification Search
USPC ..... 343/788, 873, 895, 756
See application file for complete search history.

(56) References Cited

U.S. PATENT DOCUMENTS 3,823,403 A 7/1974 Walter et al.
4,161,687 A 7/1979 Lytle et al.
(Continued)

FOREIGN PATENT DOCUMENTS

CN 201957244 U 8/2011
GB 1555756 A 11/1979
(Continued)

OTHER PUBLICATIONS

Kishk et al.; "Dielectric Resonator Antennas"; Antenna Engineering Handbook; 2007; 24 pgs; Chapter 17; The McGraw-Hill Companies.

(Continued)

*Primary Examiner* — Hai V Tran
*Assistant Examiner* — Hai Tran
(74) *Attorney, Agent, or Firm* — Hayes Soloway PC

(57) ABSTRACT

A low frequency antenna for radiating/receiving an electromagnetic wave is provided. One exemplary antenna comprises a feed port; an antenna conductor connected to the feed port; and an encapsulation at least partially surrounding the antenna conductor. The low frequency antenna comprises different functional materials used in fabrication of the wave-matching encapsulation enclosing the antenna conductor in order to match the wavelength of the compressed wave to the physical size of the resonant antenna, to match the wave impedance within encapsulation and impedance of the outer medium, to enhance the directivity gain by using non-uniform distribution of the material parameters and minimize the intrinsic impedance mismatch between the region of the encapsulation which is forming the compressed wave and the outer medium.

17 Claims, 7 Drawing Sheets

Related U.S. Application Data

(60) Provisional application No. 61/803,186, filed on Mar. 19, 2013.

(51) Int. Cl.
*H01Q 21/06* (2006.01)
*H01Q 1/38* (2006.01)

(56) References Cited

U.S. PATENT DOCUMENTS

| | | | | |
|---|---|---|---|---|
| 5,528,254 | A | 6/1996 | Howng et al. | |
| 5,541,610 | A | 7/1996 | Imanishi et al. | |
| 6,046,707 | A | 4/2000 | Gaughan et al. | |
| 6,063,719 | A | 5/2000 | Sengupta et al. | |
| 6,181,132 | B1 | 1/2001 | Runia | |
| 6,233,435 | B1 | 5/2001 | Wong | |
| 6,337,670 | B1 * | 1/2002 | Chen | H01Q 1/24 343/700 MS |
| 6,369,774 | B1 | 4/2002 | Lucidarme | |
| 6,509,880 | B2 | 1/2003 | Sabet et al. | |
| 6,549,172 | B1 | 4/2003 | Thevenot et al. | |
| 6,897,830 | B2 * | 5/2005 | Bae | H01Q 1/243 343/895 |
| 6,914,581 | B1 | 7/2005 | Popek | |
| 7,573,431 | B2 * | 8/2009 | Parsche | H01Q 1/243 343/788 |
| 8,427,387 | B1 * | 4/2013 | Josypenko | H01Q 9/27 343/859 |
| 2004/0204856 | A1 | 10/2004 | Jenkins et al. | |
| 2005/0057423 | A1 | 3/2005 | Delgado et al. | |
| 2005/0088165 | A1 | 4/2005 | Watanabe et al. | |
| 2009/0027287 | A1 | 1/2009 | Menner | |
| 2009/0278754 | A1 | 11/2009 | Tanielian et al. | |
| 2010/0315302 | A1 | 12/2010 | Diaz et al. | |
| 2011/0077036 | A1 | 3/2011 | Frank et al. | |
| 2012/0253680 | A1 | 10/2012 | Thompson et al. | |
| 2012/0274147 | A1 | 11/2012 | Stecher et al. | |
| 2012/0274536 | A1 | 11/2012 | Pan | |
| 2012/0314987 | A1 | 12/2012 | Chowdhury et al. | |

FOREIGN PATENT DOCUMENTS

| | | | |
|---|---|---|---|
| JP | 2002135036 | A | 10/2002 |
| RU | 2324950 | C1 | 5/2008 |
| RU | 99241 | U1 | 11/2010 |
| WO | 2009131344 | A2 | 10/2009 |
| WO | 2009139561 | A2 | 11/2009 |

OTHER PUBLICATIONS

Hansen; "Phased Arrays"; Antenna Engineering Handbook; 2007; 40 pgs; Chapter 20; The McGraw-Hill Companies.

Elmen; "Magnetic Alloys of Iron, Nickel, and Cobalt"; Bell System Technical Journal; pp. 113-135; 1935.

* cited by examiner

Table 1

| Material | Relative Permeability $\mu/\mu_0$ | Magnetic field | Frequency max. | Conductance. σ, S/m | Compressing Factor, max |
|---|---|---|---|---|---|
| Metallic glass | $<10^6$ | at 0.5 T | 100 kHz | $< 10^6$ | $3\ 10^8$ (100kHz) |
| Nanoperm | 80,000 | at 0.5 T | 10 kHz | $<10^6$ | $3\ 10^8$ (10 kHz) |
| Mu-metal | 20,000 | at 0.002 T | | ~10^7 | $5\ 10^8$ (10 kHz) |
| Mu-metal | 50,000 | | | $\sim 10^7$ | $8\ 10^8$ (10 kHz) |
| Permalloy | 8,000 | at 0.002 T | | $\sim 10^7$ | $3\ 10^8$ (10 kHz) |
| Electrical steel | 4,000 | at 0.002 T | | $\sim 5\ 10^6$ | $1.4\ 10^7$ (10 kHz) |
| Ferrite (NiZn) | 16–640 | | 100 kHz~1 MHz | 0.05-0.5 | $2\ 10^4$ (10 kHz) |
| Ferrite (MnZn) | >640 | | 100 kHz~1 MHz | 0.05-0.5 | $>2\ 10^4$ (10 kHz) |
| Steel | 100 | at 0.002 T | | $\sim 5\ 10^6$ | $2\ 10^6$ (10 kHz) |
| Metallic glass | $<10^6$ | at 0.5 T | 100 kHz | $< 10^6$ | $3\ 10^8$ (100kHz) |
| Nanoperm | 80,000 | at 0.5 T | 10 kHz | $<10^6$ | $3\ 10^8$ (10 kHz) |
| Mu-metal | 20,000 | at 0.002 T | | $\sim 10^7$ | $5\ 10^8$ (10 kHz) |
| Mu-metal | 50,000 | | | $\sim 10^7$ | $8\ 10^8$ (10 kHz) |
| Permalloy | 8,000 | at 0.002 T | | $\sim 10^7$ | $3\ 10^8$ (10 kHz) |
| Electrical steel | 4,000 | at 0.002 T | | $\sim 5\ 10^6$ | $1.4\ 10^7$ (10 kHz) |

FIG. 2

Table 2

| Material | $\varepsilon_r$ | Compressing Factor, max |
|---|---|---|
| Titanium dioxide | 86–173 | 15 |
| Strontium titanate | 310 | 20 |
| Barium strontium titanate | 500 | 22 |
| Barium titanate | 1250–10,000 (20–120 °C) | 100 |
| Lead zirconate titanate | 500–6000 | 80 |
| Conjugated polymers | 1.8–6 up to 100,000 | <300 |
| Calcium copper titanate | >250,000 | >500 |

FIG. 3

Table 3

| Material | σ (S/m) at 20 °C | Compressing Factor, Max (at 10 kHz) |
|---|---|---|
| Carbon (amorphous) | 1.25 to $2\times10^3$ | <0.5 $10^5$ |
| Carbon (graphite) | 2 to $3\times10^5$ ‖ basal plane<br>$3.3\times10^2$ ⊥basal plane | <0.5 $10^7$ (‖ basal plane)<br><1.5 $10^4$ (⊥basal plane) |
| Constantan | $2.04\times10^6$ | 1.3 $10^7$ |
| GaAs | $5\times10^{-8}$ to $10^3$ | <3 $10^4$ |
| Manganin | $2.07\times10^6$ | 1.3 $10^7$ |
| Mercury | $1.02\times10^6$ | 1.0 $10^5$ |

FIG. 4

LOW-FREQUENCY ANTENNA

CROSS-REFERENCE TO RELATED

This application is a continuation of International application PCT/RU2014/000168 filed on Mar. 18, 2014 which claims priority benefits to Russian patent application RU 2013112500 filed on Mar. 20, 2013 and U.S. provisional application U.S. 61/803,186 filed on Mar. 19, 2013. Each of these applications is incorporated herein by reference for all purposes.

FIELD OF THE INVENTION

The present invention relates generally to a low-frequency antenna and, more particularly, to a small low frequency antenna, and an array of such antennas having enhanced radiation directivity. Further, the present invention relates to a system for remote sensing of buried object. Furthermore, the present invention relates to a system for remote energy transfer. The antenna can be used in automotive industry, telecommunication industry, in particular, in mobile applications, natural resources exploration and other applications.

BACKGROUND OF THE INVENTION

Propagation of electromagnetic waves through materials with varying properties such as dielectric permittivity, conductivity and permeability, was and remains in the focus of fundamental research due to its enormous value for wireless communication and sensing systems. Due to high efficiency of the radiation from relatively small transmitting facilities, the high-frequency waves are usually those mostly used in communication. However, the ranges the waves can reach are limited by skin depth which usually scales inversely as square root of frequency. On the other hand, moving towards low-frequency has certain benefits such as deeper penetration and lower scattering sensitivity to the objects which are smaller as compared to the wavelength of the signals. One of the main challenges is the size of the radiating source which ordinarily has to be commensurate with the wavelength of the radiated waves in order to achieve acceptable level of radiation resistance.

Directivity is a figure of merit for antenna and it measures the power density $P(\theta, \phi)$ the antenna radiates in the direction of its strongest emission relative to the power density of the same antenna averaged over the entire solid angle $\Omega(\theta, \phi)$:

$$\mathrm{Dir}(\theta\phi)=\max\{P(\theta\phi)/(\int d\Omega P(\theta\phi))\}$$

The commonly used setting of a loop antenna implies maximum gain at $\theta=0$ assuming the plane of the radiating loop is normal to the z-axis, the latter will conventionally be considered as the radiator axis. One of the traditional methods to increase the directivity is to place the loop over a planar reflector. For this setting, the directivity is about 9 dB for spacings between the loop and the reflector in the range $0.005 \leq d\lambda \leq 0.2$, where d is distance between the loop and the reflector and $\lambda$ is the wavelength. In general, the directivity depends on the size, shape and the conductivity of the reflector and is a matter of optimization of those parameters as well, but the directivity stays around 9 dB at the maximally optimized range of the parameters, which is $s/\lambda \sim 1$ for a square shaped perfectly conducting reflector, with s standing for the length of its side.

Another method of controlling directivity is using a coaxial array in which all the loops are parallel and have their centers on a common axis. Here, the controlling parameter is ratio between the loop length and the wavelength, $2\pi r/\lambda$, where r is the loop radius and $\lambda$ is the wavelength. This method is efficient if the parameter $2\pi r/\lambda$ is close to unit. In this case, the induced currents in all loops have nearly same phase and hence there is no cancellation of the generated electromagnetic field. The mostly used configuration includes a single driven loop and several parasitic loops, in which case the feed arrangement needed to obtain the prescribed driving-point voltages can easily be obtained. If the size of the parasitic loop is slightly smaller than the wavelength (or the size of the driven loop), typically $2\pi r_{director}/\lambda \sim 0.95$, then directivity gains its maximum of about 7 dB on the side of the parasitic loop, the latter therefore considered as a director. If size of the parasitic loop is slightly smaller than the wavelength (or the size of the driven loop), typically $2\pi r_{director}/\lambda \sim 1.05$, then directivity gains its maximum of about 7 dB on the side opposite to the parasitic loop, the latter therefore considered as a reflector. Spacing between the driven loop and parasitic loops is another controlling parameter. Spacing of $d\lambda \sim 0.2$ is considered as optimum for achieving maximum directivity. The physics behind the array setting to maximize the radiation directivity is related to the differences between phases of the probing voltage at the location of the parasitic loop and the current induced by the voltage: if parasitic loop is smaller than this difference is negative, and vice-versa. The interference between fields from all elements of the array results in the distortion of the field pattern and asymmetry with respect to $\theta=0$ and $\theta=\pi$ directions, i.e. enhancement of the directivity.

Situation changes dramatically when there is a wave-compressing medium into which the driven loop is immersed, and this is the configuration which the current invention is addressing. Due to the fact that conditions of the wave compression, i.e. when the insulated driven loop is immersed into the cavity characterized by certain dimensions, shape and material parameters, can in general be destroyed by presence of other objects around, requires special consideration in order to preserve wave-compressing and achieve high directivity gain at the same time.

Small EM transmitters often include a specially shaped and designed dielectric encapsulation which enables wave compression by a factor which comprises the frequency range only few times of the fundamental resonance frequency of the transmitter. The degree of the wave compression and therefore of the frequency lowering factor is commonly limited by the material parameter used in the dielectric resonant cavity antennas.

For example, U.S. Pat. No. 3,823,403, (1974) to Walter et al, discloses a dielectric or ferrite multiturn loop antenna which has a relatively high radiation resistance in the GHz range of frequencies. The high frequency of radiation has an advantage of a high density of the information transmission due to enhanced bandwidth but often time has a disadvantage of a limited penetration depth if there are objects around where the skin depth is relatively small compared to the dimensions of the objects. Also, the wave processes similar to the Rayleigh scattering on the fluctuations of the density of the surrounding medium of the otherwise relatively large skin depth and related diffraction phenomena may also contribute to the limited extension of the wave propagation. On the other hand, the low frequency radiation offers a method of the EM transmission which is free of the indicated drawbacks of the high-frequency radiation due to the enhanced skin-depth and therefore penetration extension and diminished diffraction processes.

U.S. Pat. No. 5,541,610 (1996) to Imanishi et al, discloses a antenna for a radio communication apparatus employing a chip inductor based antenna which includes a multilayered miniaturized chip inductance element having an approximately λ/4 wavelength which achieves a half-wave dipole antenna performance together with a ground having an approximately λ/4 wavelength. In a preferred embodiment, the inductance element is formed of a plurality of thin sheets of insulating material carrying conductor segments which are connected through via-holes in the sheets to form a spiral inductance element within the stack of sheets. Direct connection avoids impedance matching circuit insertion loss and low-cost miniaturization with reduced antenna gain deterioration from surrounding conductors is provided for an effective miniature portable radio communication apparatus.

U.S. Pat. No. 6,046,707 (2000) to Gaughan, et al. discloses a ceramic multilayer helical antenna for portable radio or microwave communication apparatus. A small and durable antenna for use with radio and microwave communications is formed as a helical conductor contained in a multilayered non-ferrite ceramic chip. The dielectric constant of the ceramic is selected to match the antenna to its operating frequency, which may be in the range of 0.5 to 10.0 Gigahertz. A process for making such antennas is also disclosed.

Low profile antenna performance enhancement is often achieved by utilizing engineered electromagnetic materials.

In one such realization, an integrated planar antenna printed on a compact dielectric slab having an effective dielectric constant is described in U.S. Pat. No. 6,509,880 by Sabet et al. Design of antenna elements with significant front-to-back radiation ratio is usually accomplished through the use of metal-backed substrates. However, printed antennas on metal-backed substrates have limited bandwidth and efficiency. This problem stems from the fact that the radiated field from the image of the antenna's electric current, which is placed in close proximity and parallel to a PEC, tends to cancel out the radiated field from the antenna current itself. In this case, matching the antenna input impedance is rather difficult, and if a matching condition can be achieved, it would be over a relatively narrow bandwidth. To circumvent this difficulty, a reactive impedance surface (RIS) with random voids between planar slot elements and the ground metal plate via a dielectric slab, as proposed in U.S. Pat. No. 6,509,880, is used for the antenna dielectric substrate. The so designed RIS has the following major features: it provides a reflection power that enhances the antenna front-to-back ratio; RIS has the ability to serve as a resonating cavity resulting in the antenna size reduction due to reduced wavelength $\lambda \sim 1/\mathrm{sqrt}(\in\mu)$. However, due to inherited structural design of printed micro-strips, when conducting strips are placed between the dielectric slab and the air, the resonant surface waves along the slab surface interfere with the waves generated in the dielectric resonator resulting in a reduced power efficiency of the low profile antenna. The suggested random voids in the slab to minimize the effect of the surface waves leads to a non-uniform distribution of the material parameter, reduced coupling of the radiating slot to the dielectric slab and thus the integrated planar antenna printed on a compact dielectric slab with a metallic backing has limited capability in the frequency lowering and radiation efficiency.

Recently, a magnetic metamaterial (IEEE, Transactions on microwave theory and techniques, Vol. 54, No. 1, January 2006) was reported as extremely advantageous as a substrate for antennas. Said magnetic metamaterial is naturally non-magnetic material with metallic inclusions. The effective medium metamaterial substrate employed electromagnetically small embedded circuits (ECs) to achieve permeability and permittivity greater than that of the host dielectric. Geometric control of the ECs allowed μ and ∈ to be tailored to the application. The magnetic metamaterial exhibited enhanced μ and ∈ with acceptable loss-factor levels. The permeability of the material varying strongly and predictably with frequency, the miniaturization factor may be selected by tuning the operating frequency. Relative permeability values in the $\mu_r$=1-5 range are achievable for moderately low-loss applications. Representative antenna miniaturization factors on the order of 4-7 over a moderate (approximately 10%) transmission bandwidth and efficiencies in a moderate range (20%-35%) are demonstrated with the possibility of higher efficiencies indicated.

Using the wave-compressing technology in the area of antenna elements requires an approach which should be different from the existing methods of the controlled directivity, such as using reflecting conducting plane or a coaxial array of the loops.

The problems are arising mostly at low frequencies and are listed below.

First, matching the driving-point voltage to the input impedance depends on the spacing between parasitic elements and is not efficient at low frequencies due to large wavelength.

Second, low-frequency range is not accessible without the resonant cavity as the radiator size would scale with the wavelength if no compressor is used.

Third, minimizing the multiple-scattering and thus lateral diffusion processes from the interfaces, which implies no use of abruptly changing parameters in the space. The latter translates into the continuous change of the intrinsic impedance along the enhanced directivity.

Forth, directivity gain depends on the number of elements in the multi-component loop antenna, which however adds to the overall dimension. This is inconsistent with the requirement of keeping size down.

In connection with the above, there is a continuing necessity in small antennas operating at low frequencies and having enhanced performance characteristics, including efficiency of radiation and high directivity gain.

SUMMARY OF THE INVENTION

In view of the foregoing background, it is therefore an object of the present invention to provide a compact resonant antenna when the radiated waves have wavelength orders of magnitude smaller than the physical size of the antenna and at the same time the radiation resistance is high enough for the resonant antenna to be applied in the area of communication and wireless transfer of the electromagnetic energy.

In accordance with the teachings of the present invention, a low frequency antenna is disclosed. The low frequency antenna comprises different functional materials used in fabrication of the wave-matching encapsulation enclosing the antenna conductor in order to match the wavelength of the compressed wave to the physical size of the resonant antenna, to match the wave impedance within encapsulation and impedance of the outer medium, to enhance the directivity gain by using non-uniform distribution of the material parameters and minimize the intrinsic impedance mismatch between the region of the encapsulation which is forming the compressed wave and the outer medium.

According to one aspect of the invention a low frequency antenna for radiating/receiving an electromagnetic wave is provided, the antenna comprising: a feed port connectable to a transmission line; an antenna conductor connected to the feed port; and an encapsulation at least partially surrounding the antenna conductor, wherein the encapsulation has a core part adjacent to the antenna conductor and an external part adjacent to the core part and having a periphery, wherein the core part of the encapsulation has such a structure or is made of such a material that each of the encapsulation core part permeability, the encapsulation core part conductivity and the encapsulation core permittivity is invariable within the core part, wherein the external part of the encapsulation has such a structure or is made of such a material that at least two of the encapsulation external part permeability, the encapsulation external part conductivity and the encapsulation external part permittivity increases along at least one direction within the external part of the encapsulation from the core part to the periphery of the encapsulation, wherein the structure or material of the external part of the encapsulation is chosen to provide that the ratio of encapsulation external part permeability to the encapsulation external part permittivity is invariable within the external part of the encapsulation and equal to the ratio of the outer medium permeability to the outer medium permittivity.

In one embodiment, the encapsulation external part conductivity is invariable, while the encapsulation external part permeability and the encapsulation external part permittivity increases.

In one embodiment the encapsulation external part permeability is invariable, while the encapsulation external part conductivity and the encapsulation permittivity increases.

In one embodiment the encapsulation external part permittivity is invariable, while the encapsulation external part permeability, and the encapsulation external part conductivity increases.

In one embodiment, at least two of the encapsulation external part permeability, the encapsulation external part conductivity and the encapsulation external part permittivity increases continuously.

In one embodiment, at least two of the encapsulation external part permeability, the encapsulation external part conductivity and the encapsulation external part permittivity increase step-wise.

In some embodiments, the encapsulation external part permeability, the encapsulation external part permittivity and the encapsulation external part conductivity are increased by a factor of 5-20.

In one embodiment, the encapsulation external part permeability is varied in the range 5-10 times of that in the core, continuously or step-wise increasing on one side of the core in the direction from the periphery of the external part of the encapsulation to the core, and continuously or step-wise increasing on the opposite side of the core in the direction from the core to the periphery of the external part of the encapsulation, the ratio of the parameters including permittivity, permeability and conductivity in the external part of the encapsulation is kept equal to that in the core region.

In one embodiment, the encapsulation external part permittivity is varied in the range 5-10 times of that in the core, continuously or step-wise increasing on one side of the core in the direction from the periphery of the external part of the encapsulation to the core, and continuously or step-wise increasing on the opposite side of the core in the direction from the core to the periphery of the external part of the encapsulation, the ratio of the parameters including permittivity, permeability and conductivity in the external part of the encapsulation is kept equal to that in the core region.

In one embodiment, the encapsulation external part conductivity is varied in the range 5-10 times of that in the core, continuously or step-wise increasing on one side of the core in the direction from the periphery of the external part of the encapsulation to the core, and continuously or step-wise increasing on the opposite side of the core in the direction from the core to the periphery of the external part of the encapsulation, the ratio of the parameters including permittivity, permeability and conductivity in the external part of the encapsulation is kept equal to that in the core region.

In one embodiment, the encapsulation external part permeability and encapsulation external part permittivity is varied in the range from 1 to $10^6$.

In one embodiment, the encapsulation external part conductivity is varied in the range from 0 to $60\times10^6$ S/m.

In some embodiment, the encapsulation contains material with high permeability and high/low conductivity selected from the group of: metallic glass, nanoperm, mu-metal, permalloy, electrical steel, Ni—Zn ferrite, Mn—Zn ferrite, steel, $Fe_{49}Co_{49}V_2$, Fe3% Si, $Fe_{67}Co_{18}B_{14}Si_1$, $Ni_{50}Fe_{50}$ permalloy, $Fe_{73.3}Si_{13.5}Nb_3B_9Cu_1$ finement, $Ni_{78}Fe_{17}Mo_5$ supermalloy, material with high permittivity selected from the group of: titanium dioxide, strontium titanate, barium strontium titanate, barium titanate, lead zirconate titanate, conjugated polymers, calcium copper titanate, or material with moderate/low conductivity selected from the group of: amorphous carbon, graphite carbon, constantan, GaAs, manganin, mercury.

In some embodiments, the encapsulation contains metamaterial.

In some embodiments, the antenna operating frequency is up to 3 MHz, up to 2 MHz, up to 1 MHz.

In one embodiment, the core part has a linear size that is more than one-forth length of the antenna conductor.

In one embodiment, the external part has an extension selected from the group consisting of materials with continuously or step-wise changing parameters along an imaginable line going through the mid-point of the core part, so that wave impedance is unchanged along the line.

In one embodiment the encapsulation external part permeability and the encapsulation external part permittivity are increased with the same factor within the external part.

In one embodiment, the encapsulation external part conductivity and the encapsulation external part permittivity are increased with same factor within the external part.

In one embodiment, the antenna conductor is shaped as a linear conductor and has a length varied in the range of 0.001-1 m.

In one embodiment, the antenna conductor is shaped as an asymmetric loop has a diameter varied in the range of 0.05-1 m.

In one embodiment, the asymmetric loop is selected from the group consisting of: circular, square and diamond loop.

In one embodiment, the antenna conductor is cladded by an insulator having thickness less than 1/100 L wherein L is a length of the antenna conductor.

In one embodiment, the antenna further comprises a backing or lensing material having a high magnetic permeability for enhanced directivity gain. The high directional magnetic permeability is higher than magnetic permeability in the core part more than 5 times.

In one embodiment, the encapsulation has a geometry selecting from the group of: cylindrical disk, split cylinder, sectored cylinder, cylindrical rings, triangle, rectangle, notched rectangle, chamfered encapsulation, cone, ellipsoid, sphere, hemisphere, spherical cap, tetrahedron, perforated encapsulation, stepped encapsulation, or any combination thereof.

In one embodiment, the antenna comprises at least one heatsink. For example, the heatsink is a structural element of the antenna.

In one embodiment, the antenna comprises a reinforcement. The reinforcement is a structural element of the antenna.

In one embodiment, the encapsulation has an outer layer preventing oxidation of the encapsulation.

In a second aspect of the invention, an array of antennas comprising a plurality of a low-frequency antennas for radiating/receiving an electromagnetic wave and a coupling arrangement between said plurality of low-frequency antennas is provided, wherein each antenna of the plurality of the antennas comprising: a feed port connectable to a transmission line; an antenna conductor connected to the feed port; and an encapsulation at least partially surrounding the antenna conductor, wherein the encapsulation has a core part adjacent to the antenna conductor and an external part adjacent to the core part and having a periphery, wherein the core part of the encapsulation has such a structure or is made of such a material that each of the encapsulation core part permeability, the encapsulation core part conductivity and the encapsulation core part permittivity is invariable within the core part, wherein the external part of the encapsulation has such a structure or is made of such a material that at least two of the encapsulation external part permeability, the encapsulation external part conductivity and the encapsulation external part permittivity increases along at least one direction within the external part of the encapsulation wherein the structure or material of the external part of the encapsulation is chosen to provide that the ratio of encapsulation external part permeability to the encapsulation external part permittivity is invariable within the external part of the encapsulation and equal to the ratio of the outer medium permeability to the outer medium permittivity.

In one embodiment, the array is configured as one-dimensional antenna array or two-dimensional antenna array.

In one embodiment, the array comprises a plurality of phasers individual for each antenna.

According to a third aspect of the invention, a system for remote sensing of buried object is provided, wherein the system comprises: at least one low-frequency transmitting antenna configured to radiate an electromagnetic wave to a buried object; at least one low-frequency receiving antenna configured to receive electromagnetic wave from at least one low-frequency transmitting antenna; wherein the at least one low-frequency transmitting antenna and the low-frequency receiving antenna each comprising: a feed port connectable to a transmission line; an antenna conductor connected to the feed port; and an encapsulation at least partially surrounding the antenna conductor, wherein the encapsulation has a core part adjacent to the antenna conductor and an external part adjacent to the core part and having a periphery, wherein the core part of the encapsulation has such a structure or is made of such a material that each of the encapsulation core part permeability, the encapsulation core part conductivity and the encapsulation core part permittivity is invariable within the core part, wherein the external part of the encapsulation has such a structure or is made of such a material that at least two of the encapsulation external part permeability, the encapsulation external part conductivity and the encapsulation external part permittivity increases along at least one direction within the external part of the encapsulation wherein the structure or material of the external part of the encapsulation is chosen to provide that the ratio of encapsulation external part permeability to the encapsulation external part permittivity is invariable within the external part of the encapsulation and equal to the ratio of the outer medium permeability to the outer medium permittivity.

In one embodiment, the low-frequency transmitting antenna and the low-frequency receiving antenna are integrated together.

In another embodiment, the low-frequency transmitting antenna and the low-frequency receiving antenna are spaced apart from each other.

In one embodiment, the system operates in a mode selected from the group of: a reflecting mode, a diffraction mode, a transmission mode, or combination thereof.

According to a fourth aspect of the invention, a system for remote energy transfer is provided, the system comprising: at least one low-frequency transmitting antenna connectable to energy source and configured to radiate an electromagnetic wave to a energy consumer; and at least one low-frequency receiving antenna connectable to the energy consumer and configured to communicate with at least one low-frequency transmitting antenna by receiving the electromagnetic wave radiated by the low-frequency transmitting antenna, wherein the at least one low-frequency transmitting antenna and the at least one low-frequency receiving antenna each comprising: a feed port connectable to a transmission line; an antenna conductor connected to the feed port; and an encapsulation at least partially surrounding the antenna conductor, wherein the encapsulation has a core part adjacent to the antenna conductor and an external part adjacent to the core part and having a periphery, wherein the core part of the encapsulation has such a structure or is made of such a material that each of the encapsulation core part permeability, the encapsulation core part conductivity and the encapsulation core part permittivity is invariable within the core part, wherein the external part of the encapsulation has such a structure or is made of such a material that at least two of the encapsulation external part permeability, the encapsulation external part conductivity and the encapsulation external part permittivity increases along at least one direction within the external part of the encapsulation wherein the structure or material of the external part of the encapsulation is chosen to provide that the ratio of encapsulation external part permeability to the encapsulation external part permittivity is invariable within the external part of the encapsulation and equal to the ratio of the outer medium permeability to the outer medium permittivity; whereby the the energy consumer can be supplied with the energy from the energy source when at least one low-frequency transmitting antenna and the at least one low-frequency receiving antenna are in communication.

In one embodiment, the transmitting antenna has a solid angle of a size commensurable to an angular size of the receiving antenna.

In one embodiment, the an operating frequency of the electromagnetic wave of the transmitting antenna is selected to provides a skin depth of a medium outside the transmitting antenna of at least 2.7r, wherein r is the distance between the transmitting antenna and the receiving antenna.

In one embodiment, the system further comprises a feedback connection between the transmitting antenna and the receiving antenna.

In one embodiment, the low frequency transmitting antenna is arranged in a building and the low frequency receiving antenna is mounted on a mobile device.

In one embodiment, the mobile device is selected from the group of: notebooks, mobile phones, PDAs, smartphones, tablets.

In one embodiment, the low frequency receiving antenna is mounted on an electric vehicle.

In one embodiment, the system operates in the mode selecting from the group of: a diffraction mode, a transmission mode or combination thereof.

According to a fifth aspect of the invention, a low frequency antenna for radiating/receiving an electromagnetic wave is provided, the antenna comprising: a feed port connectable to a transmission line; an antenna conductor connected to the feed port; and an encapsulation at least partially surrounding the antenna conductor, wherein the encapsulation has the encapsulation permeability, the encapsulation conductivity and the encapsulation permittivity, wherein the encapsulation comprises a plurality of alternating first areas and second areas, wherein each first area are characterized by a first area permeability, a first area conductivity and a first area permittivity; each second area are characterized by a second area permeability, a second area conductivity and a second area permittivity; and the first area permeability, the first area conductivity and the first area permittivity are higher than the second area permeability, the second area conductivity and the second area permittivity, and wherein the ratio of a first area permeability to a first area permittivity is invariable and equal to the ratio of a second area permeability to a second area permittivity.

In one embodiment, an extension of each second area is no more than 1/10L, wherein Lisa length of the antenna conductor. Each second area is air.

Various objects, features, embodiments and advantages of the present invention will become more apparent from the following detailed description of the preferred embodiments of the invention.

BRIEF DESCRIPTION OF THE DRAWINGS

FIG. 2 illustrates Table 1 containing materials with high permeability and high or low conductivity;

FIG. 3 illustrates Table 2 containing materials with high permittivity;

FIG. 4 illustrates Table 3 containing materials with moderate or low conductivity;

DETAILED DESCRIPTION OF THE PREFERRED EMBODIMENTS

Figure 1:
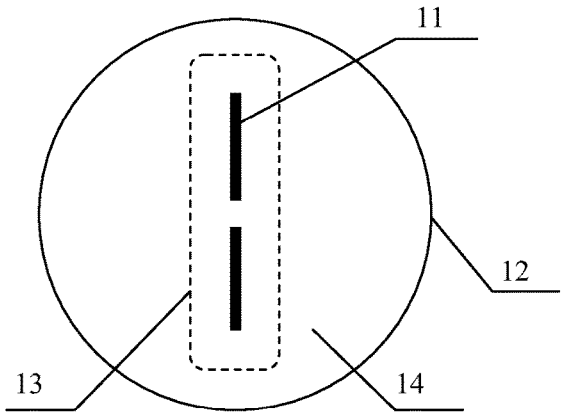
FIG. 1 is a schematic cross-sectional view of encapsulated linear center-fed antenna.

Described herein are embodiments of compact low-frequency antenna and array of antennas with enhanced radiation power.

As used herein "an antenna conductor" refers to a metallic element of the antenna by which electromagnetic waves are sent out or received.

As used herein "an encapsulation" refers to an enclosure fully or partially surrounding the antenna conductor.

As used herein "a feed point" refers to a place at which power is fed into the antenna.

As used herein the term "core" is interchangeable with "a core part" and refers to an internal part of the encapsulation surrounding the antenna conductor. In an embodiment, the core provides matching the wavelength $\lambda_{compr}$ of the compressed wave to the physical size L of the antenna conductor.

As used herein "an external part" refers to a part of the encapsulation at least partially surrounding the core part. In an embodiment, the external part functions to match intrinsic impedance of the encapsulation to intrinsic impedance of the outer medium.

As used herein the term "permittivity" is interchangeable with "relative permittivity" and refers to a permittivity of the given material with respect to that in the vacuum.

As used herein the term "permeability" is interchangeable with "a relative permeability" and refers to a permeability of the given material with respect to that in the vacuum.

As used herein the term "encapsulation permeability" is interchangeable with "encapsulation external part permeability" and refers to a permeability of the external part of the encapsulation.

As used herein the term "encapsulation permittivity" is interchangeable with "encapsulation external part permittivity" and refers to a permittivity of the external part of the encapsulation.

As used herein the term "encapsulation conductivity" is interchangeable with "encapsulation external part conductivity" and refers to a conductivity of the external part of the encapsulation.

As used herein the term "complex permittivity" refers to a complex meaning of the permittivity and can be expressed by the formulae $\in_{comp}=\in+i\sigma/\omega$.

In order to provide such compact antenna systems, one goal of the embodiments described herein is to reduce the physical size of the antenna conductor needed to match the wavelength of the radiated wave. This can be accomplished by immersing the antenna conductor in an encapsulation having the encapsulation permittivity $\in_{enc}$ (hereinafter also referred as relative encapsulation permittivity), the encapsulation permeability $\mu_{enc}$ (hereinafter also referred as relative encapsulation permeability), and the encapsulation conductivity $\sigma_{enc}$ parameters, having magnitudes selected to provide a required wavelength compression of the electromagnetic wave passing through said encapsulation.

Another goal achieved by the embodiments described herein is to enhance radiation directivity gain. This can be achieved by spatial non-uniform dispersion of the encapsulation parameters which leads to asymmetric pattern of radiation field along the radiation axis.

Yet another goal achieved by the embodiments described herein is to reduce reactive impedance and enhance radiation resistance by providing special design of the encapsulation.

In an embodiment of the invention, the materials and design of the encapsulation are chosen so that the combination of all three parameters permeability, permittivity and conductivity provides the achievement of a desired wavelength compression or lowest resonant frequency when outer medium wavelength $\lambda$ dominates the size of the antenna. Further advantages include providing the wave impedance of the antenna matching the wave impedance of the transmission lines, high gain, radiation pattern, sufficiently broad bandwidth if necessary. In practice, the material choice and the range of the parameter values is dictated by the particular application specified by the operational frequency range, required bandwidth and Q-factor, directivity gain, total radiated power, physical size of the antenna. Besides, fabrication of the composite materials with multiple parameters, i.e. including more than one out of permittivity, permeability and conductivity is a technical challenge on its own as the materials resultant parameters may not be a simple additive and the functionality may depend on issues such as inter-granular coupling, thermal budget by synthesis, as well as the frequency range and the field intensity. This subject is beyond the scope of the present disclosure.

As mentioned above, one of the restrictions on the parameters is dictated by the targeted bandwidth. Materials with high conductivity and/or dielectric constants are suitable if this specification is the least of all requirements, on the other hand materials with high permeability are required in the range of the operational frequencies if a broader bandwidth is targeted.

FIG. 1 illustrates schematically a cross-sectional view of an embodiment of a low-frequency antenna 10. The antenna 10 comprises an antenna conductor 11 entirely enclosed by a cylindrical encapsulation 12. The antenna conductor 11 comprises two linear conductors 111 and 112 of a total length. Inner ends of the conductors 111, 112 are connected to the transmission line with a feed port (not shown). The encapsulation 12 has a core part 13 adjacent to the antenna conductor 11 and external part 14 adjacent to the core part 13. The external part 12 has a radius D and can be made of material with the permittivity $\in_{ext}$, the permeability $\mu_{ext}$ and the conductivity $\sigma_{ext}$ parameters increase along at least one direction within the external part 14 of the encapsulation 12 from the core part 13 to the periphery of the encapsulation 12. The core part 13 has extension of at least L/4. Values of the permittivity $\in_{ext}$, and permeability $\mu_{ext}$, and conductivity $\sigma_{ext}$ in the core part 13 are invariable to provide uniform wavelength compression in the core part 13.

This structure of the core part 13 provides matching the wavelength $\lambda_{compr}$ of the compressed wave to the physical size L of the antenna conductor 11. This can be expressed by the relationship:

$$\lambda_{compr} \sim \frac{2}{\omega\mu_{core}^{1/2}\left(\varepsilon_{core}^2 + \frac{\sigma_{core}^2}{\omega^2}\right)^{1/4}\cos\left[\frac{1}{2}\tan^{-1}\left(\frac{\sigma_{core}}{\omega\varepsilon_{core}}\right)\right]} \sim L$$

where $\in_{core}$ is the encapsulation external part permittivity, $\mu_{ext}$ is the encapsulation external part permeability and $\sigma_{core}$ is the encapsulation external part conductivity, $\omega=2\pi f$ is angular frequency.

For example, to match the antenna conductor length L=0.05 m and $f_{resonance}$=500 kHz, the encapsulation core part is made of a composite material containing barium titanate ceramic, ferrite and amorphous carbon, and has relative encapsulation core permittivity $\in_{core}$=100, relative encapsulation core permeability $\mu_{core}$=100, and encapsulation core conductivity $\sigma_{core}$=20 S/m.

In one embodiment, the encapsulation external part permittivity $\in_{ext}$, the encapsulation external part permeability $\mu_{ext}$ are selected to match wave impedance within external part to wave impedance in the outer medium adjacent to the encapsulation. This can be expressed by the relationship:

$$\text{sqrt}(\mu_{ext}/\in_{ext})=\text{sqrt}(\mu_{out}/\in_{out}),$$

wherein $\mu_{out}$ is out medium permeability and $\in_{out}$ is out medium permittivity.

In some cases a complex permittivity of the external part and a complex permittivity of the outer medium can be used instead of permittivity of the external part and permittivity of the outer medium respectively.

For example, the outer medium is air having relative permeability $\mu_{out}$=1, relative permittivity $\in_{out}$=1, and the encapsulation external part is made of the composite material sintered with the pellets of the ferrite and powder of barium titanate ceramic, and has relative permeability $\mu_{ext}$=100 and relative permittivity $\in_{ext}$=100. The wave frequency compression factor is $\text{sqrt}(\mu_{ext} \in_{ext})/\text{sqrt}(\mu_{out} \in_{out}) \sim 100$.

In a preferred embodiment, the said three parameters, i.e. permittivity, permeability, and conductivity increases, either continuously or non-continuously from the core part to the periphery within the external part 14 of the encapsulation 12 to match intrinsic impedance of the encapsulation to intrinsic impedance of the outer medium.

In one embodiment, the encapsulation external part permeability is varied in the range 5-10 times of that in the core, in particularly, 5, 6, 7, 8, 9 or 10 times, and continuously or step-wise increasing on one side of the core in the direction from the periphery of the external part of the encapsulation to the core, and continuously or step-wise increasing on the opposite side of the core part 13 in the direction from the core to the periphery of the external part of the encapsulation, the ratio of the parameters including permittivity, permeability and conductivity in the external part of the encapsulation is kept equal to that in the core part.

In one embodiment, the encapsulation external part permittivity is varied in the range 5-10 times of that in the core part, in particularly, 5, 6, 7, 8, 9 or 10 times, and continuously or step-wise increasing on one side of the core in the direction from the periphery of the external part of the encapsulation to the core, and continuously or step-wise increasing on the opposite side of the core in the direction from the core to the periphery of the external part of the encapsulation, the ratio of the parameters including permittivity, permeability and conductivity in the external part of the encapsulation is kept equal to that in the core region.

In one embodiment, the encapsulation external part conductivity is varied in the range 5-10 times of that in the core, in particularly, 5, 6, 7, 8, 9 or 10 times, and continuously or step-wise increasing on one side of the core in the direction from the periphery of the external part of the encapsulation to the core, and continuously or step-wise increasing on the opposite side of the core in the direction from the core to the periphery of the external part of the encapsulation, the ratio of the parameters including permittivity, permeability and conductivity in the external part of the encapsulation is kept equal to that in the core region.

In one embodiment, the external part 14 has a non-uniform distribution of the material parameters to enhance directivity gain. To fulfill this, the external part 14 may include regions with higher values for the material parameters on one side of the encapsulation 12 and lower values on the opposite side of the encapsulation 12.

For example, the external part is prepared as a result of sintering of the ceramic powder $BaTiO_3$ of a high permittivity $\in_{ext}$~1000 with ferrite pellets of a high permeability $\mu_{ext}$~1000, in order to achieve a combined effect of the wave compression in the core part 13. The relative gain in this case can be made as high as 1000.

In one embodiment, the external part comprises the following materials suitable for wave compression, but is not limited by those materials. Materials with high permeability and high/low conductivity can be selected from the list of: metallic glass, nanoperm, mu-metal, permalloy, electrical steel, Ni—Zn ferrites, Mn—Zn ferrites, steel, $Fe_{49}Co_{49}V_2$, Fe3% Si, $Fe_{67}Co_{18}B_{14}Si_1$, $Ni_{50}Fe_{50}$ permalloy, $Fe_{73.3}Si_{13.5}Nb_3B_9Cu_1$ finement, $Ni_{78}Fe_{17}Mo_5$ supermalloy. Materials with high permittivity can be selected from the list of: titanium dioxide, strontium titanate, barium strontium titanate, barium titanate, lead zirconate titanate, conjugated polymers, calcium copper titanate. Materials with moderate/low conductivity can be selected from the list of: amorphous carbon, graphite carbon, constantan, GaAs, manganin, mercury.

The materials listed above can also be combined, either by means of high-temperature sintering, or by embedding into a polymer host, or by a hetero-structural design of the encapsulation structure when layers of different materials is alternating.

Targeted material parameters such as permeability and permittivity are achievable either through texturing during material fabrication, through stoichiometric manipulation while material growth, applying a quenching method such as a static external field while material growth, or combination of above methods. An example here is given to demonstrate how a targeted relative permeability $\mu_r$ can be achieved using stoichiometry for a given amplitude of the magnetic induction (flux density) B, measured in Gauss, the latter determined by the amplitude of the current in the antenna conductor, which in its turn is determined by the required radiation power. If the magnetic induction at maximum is 4000 Gauss to achieve a required power of radiation, then the following stoichiometric formulas can be used to achieve the desirable relative permittivity:

45 Permalloy (45% Ni 55% Fe):$\mu_r$=20.000

3.8-78.5 Cr-Permalloy (3.8% Cr, 78.5% Ni,17.7% Fe): $\mu_r$=56.000

3.8-78.5 Mo-Permalloy (3.8% Mo,78.5% Ni,17.7% Fe): $\mu_r$=72.000

78.5 Permalloy (78.5% Ni,21.5% Fe): $\mu_r$=96.000

Other examples of designing materials with a targeted permeability using special heat treatment of magnetic alloys including permalloys are given in "Magnetic Alloys of Iron, Nickel, and Cobalt", Bell System Technical Journal by G. W. Elmen (1950). Another example of designing materials with a targeted dielectric permittivity is (Ba_[1-x],Sr_x)TiO3 ceramic systems, which all are featured by common perovskite structure, involves using both stoichiometry and texture. As a general method of growing polycrystalline material, liquid sintering of granular barium oxide, titanium oxide and strontium oxide is being used to achieve certain permittivity within wide range of frequencies. In general, permittivity of the material depends on the granular size sintered in a texture, and the amount of substitution of Ba with Sr—permittivity scales roughly as a linear function of x content in formula (Ba_[1-x], Sr_x)TiO3. Relative permittivity of one end material BaTiO3 (x=1) obtained by sintering of highly dense oxide precursors can get as high as 12.000, whereas another end material SrTiO3 (x=0) has a permittivity of 330 at room temperature as measured at 1 kHz (see M. E. Lines. Principles and Applications of Ferroelectrics and Related Materials//Oxford University Press, 1977).

Another example of fabricating materials with a certain conductivity involves using carbon black powder of a certain granular size embedded into a polymer. The conductivity of carbon black in styrene-butadiene rubber is shown to scale as a cubic root of carbon concentration due to the effect of electrical percolation and can be changed from 1 S/m to 10,000 S/m if specific concentration of carbon black is increased from 2% to 20%, as shown e.g. in "Conductive Carbon black" from "Carbon black: Science and Technology" by N. Probst (1993).

Further, the encapsulation 12 can be obtained by fabrication of a composite or textured material using an embedding method of functional components into a polymer host. In one such embodiment, a ceramic powder such as CCTO or PZT, and permeable pellets such as of Ferrite or mu-metal is embedded into a polymer host such as Polyvinylidene Difluoride (PVDF2) or epoxy. This method is convenient to achieve a gradual change of the material parameters across the external part 14 of the encapsulation 12 to meet the above requirements.

The antenna 10 in accordance with the preferred embodiment comprises the antenna conductor 11 having the overall length varying in the range of 0.01-1 m. The antenna conductor 11 is made of material selected from the group of: cupper, aluminum, stainless steel. The encapsulation is shaped as a cylinder with the radius varying in the range of 0.02-2 m and the height varying in the range of 0.011-1.1 m. The core part 13 is formed as a cylinder and has the radius varying in the range of 0.015-1.5 m and the height varying in the range of 0.011-1.1 m. The external part 14 is formed as two one-half cylinders of the radius varying in the range of 0.02-2 m and the height varying in the range of 0.011-1.1 m. The encapsulation external part permeability, the encapsulation external part conductivity and the encapsulation external part permittivity increase along at least one direction within the external part of the encapsulation from the core part to the periphery of the external part 14 by the factor of 5-20, in particularly by the factor 5, 6, 7, 8, 9, 10, 11, 12, 13, 14, 15, 16, 17, 18, 19 or 20.

In a particular realization, the antenna conductor is made from copper and has diameter of 0.001 m. The length of the antenna conductor 11 is varying in the range of 0.01-0.05 m. The external part 14 is made of barium titanate with permittivity varying in the range of 100-1000, ferrite with permeability varying in the range of 100-10000 and carbon texture with conductivity varying in the rage of 20-1000 S/m. The core part 13 has the radius varying in the range of 0.015-0.075 m and the height varying in the range of 0.011-0.055 m. The external part 14 has the radius varying in the range of 0.02-0.01 m and the height varying in the range of 0.011-0.055 m.

In another particular realization the antenna conductor is made from aluminum, has the diameter of 0.004 m and the length varying in the range of 0.04-01 m. The external part 14 is made of composite material containing titanium dioxide with permittivity varying in the range of 86-173, electrical steel with permeability varying in the range of 1000-4000 and constantan with conductivity varying up to $10^6$ S/m. The core part has the radius varying in the range of 0.053-0.13 m and the height varying in the range of 0.09-0.023 m. The external part has the radius varying in the range of 0.08-0.2 m and the height varying in the range of 0.09-0.023 m.

In another particular realization the antenna conductor is made from copper, has the diameter of 0.008 m and the length varying in the range of 0.08-015 m. The external part 14 is made of composite material containing conjugated polymer with permittivity varying in the range of 10-100000, permalloy with permeability varying in the range of 1000-8000 and amorphous carbon with conductivity varying in the range of 20-1000 S/m. The core part has the radius varying in the range of 0.083-0.23 m and the height varying in the range of 0.088-0.016 m. The external part has the radius varying in the range of 0.16-0.3 m and the height varying in the range of 0.088-0.016 m.

In another particular realization the antenna conductor is made from copper, has the diameter of 0.01 m and the length varying in the range of 0.12-0.25 m. The external part 14 is made of composite material containing lead zirconate titanate with permittivity varying in the range of 500-6000, Ferrite (NiZn) with permeability varying in the range of 16-640 and amorphous carbon with conductivity varying in the range of 20-1000 S/m. The core part has the radius varying in the range of 0.14-0.33 m and the height varying in the range of 0.25-0.51 m. The external part has the radius varying in the range of 0.24-0.5 m and the height varying in the range of 0.13-0.26 m.

In another particular realization the antenna conductor is made from copper, has the diameter of 0.02 m and the length varying in the range of 0.25-0.75 m. The external part 14 is made of composite material containing barium strontium titanate with permittivity varying in the range of 200-500, NiZn ferrites with permeability varying in the range of 16-640 and manganin with conductivity varying in the range of $1.9 \cdot 10^6$-$2.07 \cdot 10^6$ S/m. The core part has the radius varying in the range of 0.33-1.0 m and the height varying in the range of 0.51-1.6 m. The external part has the radius varying in the range of 0.5-1.5 m and the height varying in the range of 0.51-1.6 m.

In another particular realization the antenna conductor is made from copper, has the diameter of 0.03 m and the length varying in the range of 0.60-1.00 m. The external part 14 is made of composite material containing $CaCu_3Ti4O_{12}$ with permittivity varying in the range of 250000-$10^6$, permalloy with permeability varying in the range of 4000-8000. The core part has the radius varying in the range of 0.8-1.33 m and the height varying in the range of 0.61-1.1 m. The external part has the radius varying in the range of 1.20-2.00 m and the height varying in the range of 0.61-1.0 m.

It will be understood by those skilled in the art that the antenna 10 can have other shapes and materials than those mentioned above.

Characteristics of indicated above materials suitable for wavelength compression are given in Table 1 on FIG. 2, Table 2 on FIG. 3, and Table 3 on FIG. 4. Compressing factor stands for the wavelength in the encapsulation material relative to that in the air at a given frequency.

It should be noted that the wave compressing factor is frequency-dependent if a conducting encapsulation material is used. The listed materials can also be combined, either by means of high-temperature sintering, or by embedding into a polymer host, or by a hetero-structural design of the envelope structure when layers of different materials is alternating.

In one embodiment the antenna 10 comprises at least one heat sink (not shown) in order to dissipate heat generated by the antenna and, therefore, to provide at least one stable operating temperature of the encapsulation. This at least one stable operating temperature ensures stable values of the encapsulation external part permeability, the encapsulation external part conductivity and the encapsulation external part permittivity at working range of temperature. The heat sink can be implemented as a structural element of the antenna. For example, the encapsulation can have slotted structure which provides heat sink function. In other cases this structure can be combined with a forced fluid cooling system. An example of the fluid cooling system is antenna conductor performed in the form of a pipe with coolant flowing through.

In one embodiment, the encapsulation 12 has a reinforcement enhancing mechanical strength of the encapsulation 12 and preventing its damage due to vibration, shaking, or another external impact. The reinforcement can be implemented either as a structural element of the antenna or as an element of the encapsulation. For example, composite polymer materials such as fiber-reinforced plastic including epoxy, carbon fiber, vinylester, polyester thermosetting plastic, phenol formaldehyde resins, glass fiber with relative permittivity much smaller than the minimum encapsulation external part permittivity or than minimum encapsulation external part conductivity over the operational angular frequency is suitable for structural reinforcement and electric insulation at the same time.

In one embodiment, the encapsulation comprises a coating layer preventing oxidation of the encapsulation as a result of exposure to environment.

In one embodiment the external part has a structure selected from the group consisting of materials with continuously or step-wise changing parameters along an imaginable line going through the mid-point of the core part, so that a wave impedance is unchanged along the line.

There are different feeding schemes can be used to feed the antenna 10. For example, the feeding scheme can be selected from the group consisting of: coaxial probe, aperture coupling with a, aperture coupling with a coaxial feedline, aperture coupling with coaxial feedline, waveguide coupled aperture, coplanar feed, soldered through probe, slot line, conformal strip, and direct image guide. This makes antennas easy to integrate with existing technologies.

Figure 5:
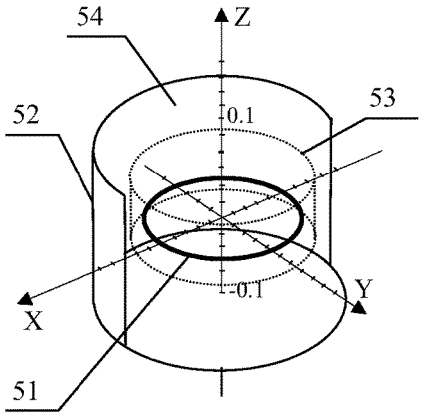
FIG. 5 is a schematic diagram of an encapsulated loop antenna with variable material parameter along the antenna conductor axis.
Figure 6:
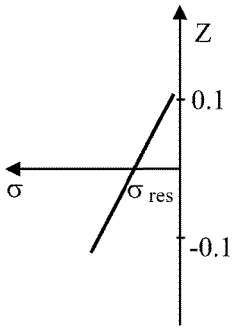
FIG. 6 illustrates a distribution of encapsulation conductivity along the antenna conductor axis of the antenna of FIG. 5.

FIG. 5 shows an embodiment of a low-frequency antenna 50 comprising an antenna conductor 51 entirely immersed in an encapsulation 52. The antenna conductor 51 is formed as a loop of radius R and of length L. The encapsulation 52 has a core part 53 and an external part 54. The core part 53 is arranged around antenna conductor 51 and has an extension of no less than L/2 around the antenna conductor. The core part 53 has the invariable encapsulation core permittivity, the encapsulation core permeability, and the encapsulation core conductivity to provide uniform wavelength compression. The external part 54 has the encapsulation external part permittivity, the encapsulation external part permeability, and the encapsulation external part conductivity, where the encapsulation external part conductivity is linearly varied along the antenna conductor axis z, from a maximum on the back (−z) of the encapsulation 52 to a value in the core part 53 and then dropping on the front (+z). Dependence between the directivity of the antenna and the gradient of encapsulation conductivity shown on FIG. 6 demonstrates existence of the directivity optimum when conductivity changed within encapsulation.

Figure 7:
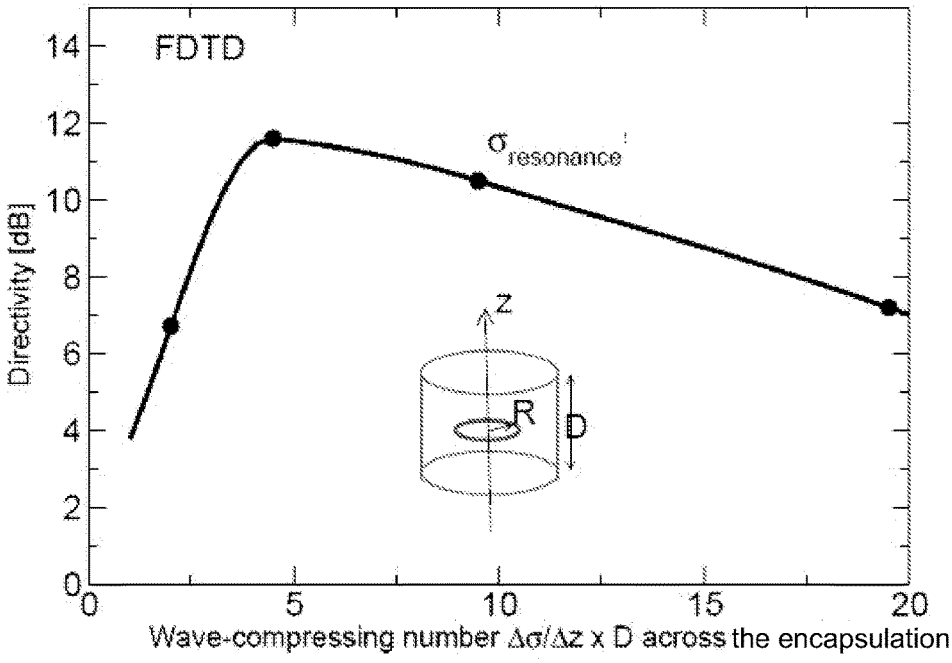
FIG. 7 illustrates dependence between the directivity of the antenna and a gradient of the encapsulation conductivity of the antenna of FIG. 5.

For example, if the encapsulation 52 has size D=2R, where R=0.05 m is a radius of the antenna conductor 51, the directivity optimum is achieved in the external part of the encapsulation 52 where the encapsulation external part conductivity $\sigma_{ext}$ changes from 5 S/m to 0.5 S/m, as shown on FIG. 7.

In one embodiment, different geometries of the dielectric encapsulation 52 are used to enhance bandwidth. The encapsulation may be designed as cylindrical disk, split cylinder, sectored cylinder, cylindrical rings, triangle, rectangle, notched rectangle, chamfered encapsulation, cone, ellipsoid, sphere, hemisphere, spherical cap, tetrahedron, perforated encapsulation, stepped encapsulation, or any combination thereof.

For example, modification of the dielectric encapsulation 52 in the form of a stepped pyramid or cylinder has an ultra wideband as high as 60 percent. Further, modification of the encapsulation 52 in the form of split conical has high wideband about 50 percent. An inverted tetrahedral encapsulation exhibits a wide bandwidth of about 40 percent (Ahmed A. at al, Dielectric Resonator Antenna. Antenna Engineering handbook, Chapter 17).

In one embodiment, the antenna conductor 51 is shaped as a circular loop, square loop, diamond loop or other axially symmetric loop.

In one embodiment an array of antennas comprises a plurality of low-frequency antennas for radiating/receiving an electromagnetic wave and a coupling arrangement between said plurality of low-frequency antennas. Each of said antennas accomplished as antennas described above with references to FIG. 1-7.

It is preferably, if the array of antennas comprises a plurality of phasers individual for each antenna.

Further, the array of antennas configured as one-dimensional antenna array or as two-dimensional antenna array.

The array of antennas is used to control of low-frequency radiation pattern. In order to have an active control over the beam-width and its scanning angle, the method of the phased arrays is applied here to a set of N encapsulated resonant transmitter antennas, which are distributed and oriented in a certain spatial configuration. The amplitude and phase excitations of each transmitter antenna can be individually controlled to form a radiated beam of any desired shape in space in order to minimize the power losses and enhance real time scanning capabilities. The position of the beam in space is controlled electronically by adjusting the phase of the excitation signals at the individual transmitting antenna. In accord with the phased array technology, the beam scanning is accomplished with the antenna aperture remaining fixed in space without the involvement of mechanical motion in the scanning process.

The capability of rapid and accurate beam scanning in microseconds permits the system to perform multiple functions, either interlaced in time or simultaneously. An electronically steered antenna array is able to track a large number of targets and illuminate some of these targets with EM energy if additionally a feedback system between transmitting antenna and receiving antenna is being used to optimize the wireless power transfer or communication quality.

An example of such a realization, a set of N linear center-fed encapsulated transmitting antennas is arranged in a linear array equally spaced along a line. The criterion of the grating (side) lobes being suppressed at a scanning angle A is determined by the ratio between the transmitting antennas spacing d and the wavelength $\lambda$ in the outer medium, which should be less than 1+sin(A). In all those low-frequency 100 Hz-1 MHz applications which involves air as the outer medium, this criterion is fulfilled due to large wavelength from 3000 km to 300 m, which at any reasonable spacing d (being much less than the wavelength) implies no grating lobes of radiation. Hence, the design of the phased array at low frequencies is dictated by the requirements for the directivity, beam-width (power transfer application), bandwidth (communication application) and the total radiated power. In fact, since phase differences between the array transmitting antennas by synchronized feeding are negligibly small as compared to the wavelength ($d \ll \lambda$) the actual array configuration at lower frequencies has an impact on the resultant radiation pattern mostly through the directivity of the individual transmitting antennas. For example, if all linear transmitting antennas are aligned along a line, then the radiation pattern is flattened in the equatorial plane with no side lobes, even if the actual spacing between transmitting antennas is randomized. Such a narrow beam width at distances much smaller than the wavelength provides with high resolution of detection if the array is used for a remote detection of mineral deposits, hidden/exposed objects as employed within the radar technology. A network of phasers (phase shifters, delay phase-type elements) can also be used to actively control the radiation scanning rate and the beam-width without an actual mechanical moving of the array. Both amplitude tapering and phase tapering methods can be used in a way similar to the arrays of ordinary isotropic transmitting antennas (as described e.g. in Hansen R. C. Phased Arrays// Antenna Engineering Handbook, 2007, Chapter 20).

For example, by placing N elementary enveloped loop transmitting antennas within a circular area and center-feeding outer transmitting antenna such that their phases are shifted with respect to those of the inner transmitting antenna fed by the same power generator, all implemented through a manifold of the individual phasers, an additional narrowing of the beam can be realized due to cancellation of the electromagnetic signals in the outer shell of the radiated beam. Due to reciprocity theorem, same methods of the phased arrays apply also to the array of the receiving antennas.

Figure 8:
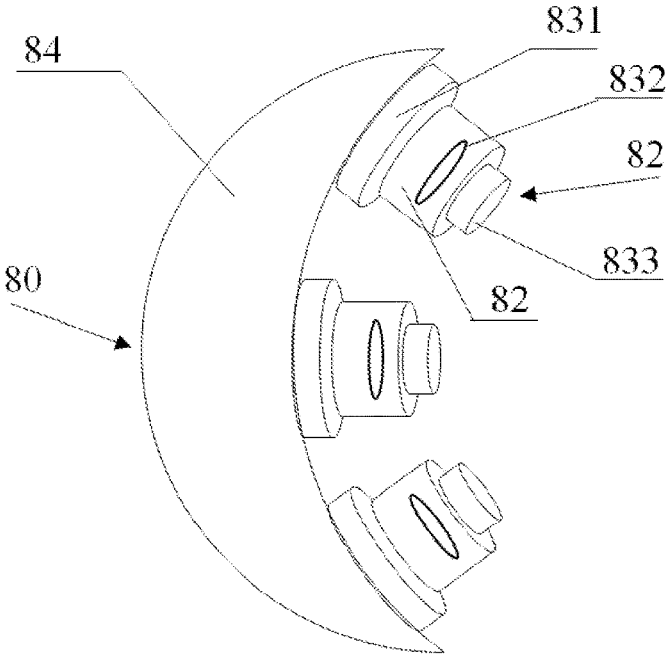
FIG. 8 is an embodiment of an antenna system comprising the loop antenna of FIG. 5.

FIG. 8 shows an embodiment of an antenna array 80, comprising plurality of antennas 81. Each antenna 81 has an antenna conductor 82 in the form of a loop entirely immersed in cylindrical encapsulation 83. The encapsulation 83 has a step-wise configuration and is made by stacking the functional layers in alternating order, where the layers have a mesh design such that at least a 2-2 type connectivity is achieved. Each layer has certain functionality, either dielectric, permeable, conducting, or their combination. For example, the encapsulation 83 comprises two external parts in the form of a bottom layer 831 and a top layer 833, and a core part layer 832 arranged between the bottom layer 831 and the top layer 833. Each of the layers has different value of permittivity, permeability, and conductivity. For example, bottom layer 831 have low ratio of conductivity and permeability, core part layer 832 have medium ratio of conductivity and permeability, and top layer 833 have high ratio of conductivity and permeability. Thus, the ratio of the conductivity and permeability is varied along the encapsulation axis.

Further, the individual phasers (not shown) are used to establish the phase shift between antennas in order to control the array main lobe scanning without mechanical motion and the beam width.

The antenna array 80 in accordance with one of the preferred embodiments comprise plurality of antennas 81 each of which has the loop antenna conductor with the radius of loop varying in the range of 0.05-1 m. The antenna conductor 11 is made of material selected from the group of: cupper, aluminum, stainless steel. The bottom layer is shaped as a cylinder with the radius varying in the range of 0.15-3 m and the height varying in the range of 0.05-1 m. The core part layer is shaped as a cylinder and has the radius varying in the range of 0.1-2 m and the height varying in the range of 0.05-1 m. The top layer is shaped as a cylinder with the radius varying in the range of 0.075-1.66 m and the height varying in the range of 0.05-1 m.

For example, the antenna conductor is made of copper and has the radius varying in the range of 0.05-0.1 m and diameter of 0.005 m. The bottom layer has the radius varying in the range of 0.15-0.3 m. The core part layer has the radius varying in the range of 0.1 m to 0.2 m. The top layer has the radius varying in the range of 0.075-0.13 m. Each layer has the height ranging from 0.05 m to 0.1 m. Each layer of the encapsulation is made of composite material containing barium strontium titanate with permittivity varying in the range of 200-500, NiZn ferrites with permeability varying in the range of 16-640 and manganin with conductivity varying in the range $1.9\cdot10^6$-$2.07\cdot10^6$ S/m.

In another example, the antenna conductor made of copper and has the radius varying in the range of 0.08-0.12 m and diameter of 0.004 m. The bottom layer has the radius varying in the range of 0.18-0.27 m. The core part layer has the radius varying in the range of 0.08 m to 0.12 m. The top layer has the radius varying in the range of 0.12-0.18 m. Each layer has the height ranging from 0.06 m to 0.09 m. Each layer of the encapsulation is made of composite material containing conjugated polymer with permittivity varying in the range of 10-100,000, permalloy with permeability varying in the range of 4000-8000 and amorphous carbon with conductivity varying in the range 20-1000 S/m.

In one more example, the antenna conductor made of copper and has the radius varying in the range of 0.12-0.6 m and diameter of 0.005 m. The bottom layer has the radius varying in the range of 0.27-1.35 m. The core part layer has the radius varying in the range of 0.18 m to 0.9 m. The top layer has the radius varying in the range of 0.12-0.6 m. Each layer has the height ranging from 0.09 m to 0.45 m. Each layer of the encapsulation is made of composite material containing barium titanate with permittivity varying in the range of 500-10000, permalloy with permeability varying in the range of 4000-8000 and amorphous carbon with conductivity varying in the range 10-1000 S/m.

In one more example, the antenna conductor made of copper and has the radius varying in the range of 0.5-1 m and diameter of 0.005 m. The bottom layer has the radius varying in the range of 1.5-3 m. The core part layer has the radius varying in the range of 0.75 m to 1.5 m. The top layer has the radius varying in the range of 0.5-1.0 m. Each layer has the height ranging from 1 m to 2 m. Each layer of the encapsulation is made of composite material containing barium titanate with permittivity varying in the range of 500-10000, permalloy with permeability varying in the range of 4000-8000 and GaAs with conductivity varying in the range 1-1000 S/m.

For example, the bottom layer 831 of the antenna 81 has thickness of 0.05 m and diameter of 0.20 m and is made of a composite material engineered from amorphous carbon with conductivity of 15 S/m and ferrite with relative permeability of 100, and. The core part layer 832 has thickness of 0.05 m and diameter of 0.15 m, and is made of a composite material engineered from amorphous carbon with conductivity of 10 S/m and ferrite with relative permeability 100. The top layer 833 has thickness of 0.05 m and diameter D=0.1 m, and is made of a composite material engineered from amorphous carbon with conductivity of 5 S/m and ferrite with relative permeability of 100. The antenna conductor 82 has radius R=0.05. This structure of the antenna system provides with a high directivity gain of 13 dB and the wave frequency compression factor of 16000.

The antenna array 80 can comprise a backing or lensing material 84 having a high magnetic permeability for enhanced directivity gain. The magnetic permeability of the lensing material 84 is higher than magnetic permeability in the core part more than 5 times. Thus, the lensing material 84 traps the electromagnetic wave generated by antenna conductor 82, causing the electromagnetic wave to reverse or shift direction back towards the first direction. Exemplary high permeable materials include iron, some permanent magnets, some rare earth materials, etc.

Figure 9:
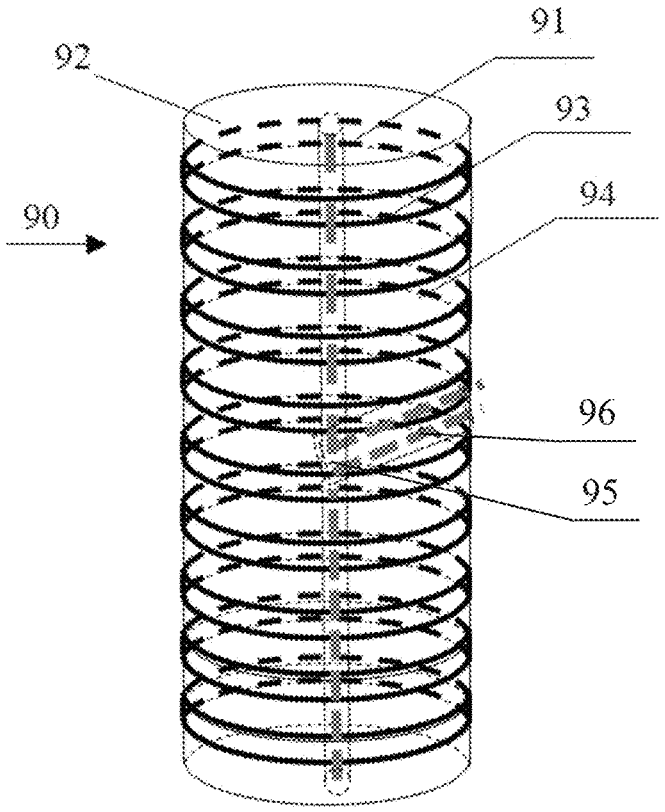
FIG. 9 is a perspective view of an embodiment of a linear antenna.

FIG. 9 illustrates an embodiment of a low-frequency antenna 90. The antenna 90 comprises a center-fed linear antenna conductor 91 entirely immersed in an encapsulation 92. The encapsulation 92 comprises a plurality of first areas 93 and a plurality of second areas 94. The first area 93 is characterized by a first area permeability $\mu_1$ and the first area permittivity $\in_1$. The second area is characterized by a second area permeability $\mu_2$ and second area permittivity $\in_2$. The first area permeability $\mu_1$, the first area permittivity $\in_1$ and the second area permeability $\mu_2$ and second area permittivity ∈2 are invariable from point to point. Each second area 94 is formed as a slot. It is preferably if each slot is filled with a material which corresponds to the medium where antenna is expected to be used. For example, slots are air-filled if antenna is in the air. The ratio between the parameters is set equal, □$_1$□□$_2$□□□□$_1$□□$_2$, so that the wave-compressing factor $$f_{wc} = \sqrt{\frac{\varepsilon_1\mu_1}{\varepsilon_2\mu_2}} > 1$$

may be achieved without changing the wave impedance Z ~sqrt(□$_1$□□$_1$) by moving from the interior to the exterior of the encapsulation 92.

The thickness and number of each slot 94 can vary to achieve certain combination of enhanced radiation resistance, reduced reactive impedance, bandwidth, directivity etc.

It is preferably if thickness of the slots 94 does not exceed 1/10 L, where L is a length of the antenna conductor 91 to provide uniform material parameters in the core part and to meet the wave impedance matching condition.

The antenna conductor 91 is preferably cladded with an insulator having the thickness not exceeding 1/100L, where L is a length of the antenna conductor 91. The maximum radiation resistance at an operating resonant frequency is achieved at a vanishing thickness of the insulator.

To achieve an enhanced omni-directional power gain for TM01δ (Transversal Magnetic) mode of radiation, the first area 93 can be made of amorphous carbon having conductivity of $\sigma_1$=17 S/m and pressed into a circular ring of thickness 5 mm. The number of the rings is 18. The overall height of the encapsulation 92 is varying in the range of 0.51-1.1 m, the radius of the circular ring is varying in the range of 0.5-1.1 m. The second areas is formed as a slots. The number of the slots is 17, each of which has thickness 0.1 cm and is filled with ferrite with the relative permeability $\mu_2$=100.

The antenna conductor 91 consists of two pieces of copper wire having diameter 4 mm, and length varying in the range of 0.5-1.0 m with mid-gap. The antenna conductor 91 is insulated by Teflon tape.

The second areas 94 is placed equidistantly such that no the second areas 94 is arranged in the middle of the encapsulation 92, where the feed port 95 is located. Transmission lines 96 are attached directly to the inner ends of the antenna conductor pieces.

In one example, the lowest resonant frequency mode in presence of the encapsulation 92 is set at 12 MHz, with the radiation resistance of $R_r$=1.5 Ohm and the total radiation power of $P_r$=100 Watt at 100 Volt of the input voltage, with 50 Ohm of the input impedance. The second areas 94 provide impedance matching to compensate the capacitive reactance of $Z_{cap}$=1/0.0027 nF×12 MHz=4.4e+6 Ohm of the antenna. The bandwidth with wave matching encapsulation mounts to 2 MHz.

In contract, assuming that the total radiation power $P_r$=100 Watt at 100 Volt of the input voltage, with 50 Ohm of the input impedance, the natural lowest resonance of the same radiating unit with no encapsulation is 140 MHz with the radiation resistance of $R_r$=0.03 Ohm, In this case the bandwidth with wave matching encapsulation mounts to 20 MHz.

Thus, an inclusion of the permeable material into the encapsulation 92 provides increasing the bandwidth at an operating frequency and matching the impedance of the transmission lines.

In another embodiment, a liner centered antenna comprises a cylindrical encapsulation 92 having second areas 93 made of MnZn ferrite with the relative permeability $\mu_1$=1000 and the conductivity $\sigma_1$=0.5 S/m. The encapsulation 92 is in the form of cylinder with height h=0.1 m which is equal to the total length of the antenna conductor, and with diameter 0.1 m. The encapsulation 92 has 18 second areas in the form of air-filled slots 94 with thickness of 0.001 m. The lowest resonant frequency is 500 kHz, the radiation resistance is 1.2 Ohm and the bandwidth is over 50 kHz.

Design of composite materials with certain permittivity, permeability and conductivity can be achieved within sintering method using powder precursors of certain granular sizes and stoichiometry, as well as texturing such as layered design. As an example, a two-phase composite material possessing equal permittivity and permeability to match the wave impedance of the air, can be realized in the layered structure along the electromagnetic wave propagation vector, e.g. alternating cylinders in case of a linear center-fed encapsulated transmitter, whereas the thickness of each layer is much smaller than the compressed wave length. Details of design for the layered composite materials, as well as threading-type composite structures are e.g. described by D. S. Killips "Composite material design and characterization for RF applications", 2007. For example, alternating cylindrical layers of (BaTiO3)/(Ferrite) each 0.01 m thick, permittivity 10,000 (BaTiO3), permeability 10,000 (Ferrite) linear encapsulated antenna with 0.1 m long antenna conductor would provide a wave compression of roughly sqrt (10,000*10,000)=10,000, thus lowering resonant frequency from 1.4 GHz of same-size antenna without encapsulation to 140 kHz with encapsulation. Other texturing design such as embedded spherical grains and rods can also be used in fabrication of composite materials.

Figure 10:
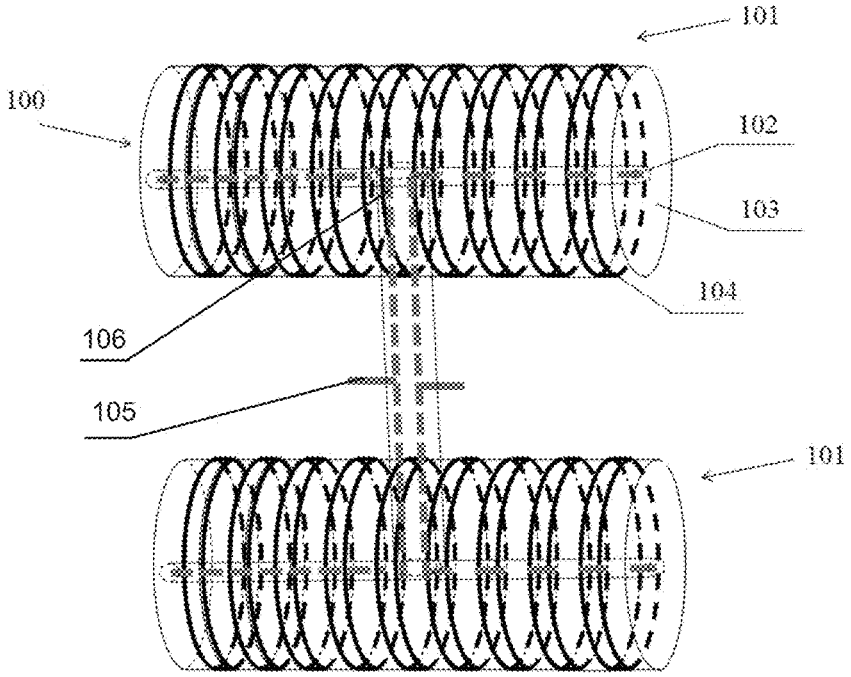
FIG. 10 is a perspective view of an embodiment of an antenna system comprising the linear antennas of FIG. 8.

FIG. 10 shows an embodiment of an antenna array 100. The antenna array 100 comprises two antennas 101, similar to antenna 90 discussed above. Each antenna 101 has a linear antenna conductor 102 entirely immersed in an encapsulation 103, similar to the encapsulation 92, discussed above, surrounding said antenna conductor 102. The encapsulation 102 is similar to the encapsulation 92 discussed above.

All antennas 101 are arranged in parallel along the transmission lines 105 with feed ports 106 and are fed synchronously. The number of the antennas 101 and distance between them can vary. The antenna array 100 can be used to achieve certain pattern of radiation and particularly enhanced directivity gain.

In one embodiment a system for remote sensing of buried object comprises at least one low-frequency transmitting antenna configured to radiate an electromagnetic wave to a buried object and at least one low-frequency receiving antenna configured to receive electromagnetic wave from at least one low-frequency transmitting antenna. Each of the transmitting antenna and the receiving antenna can be accomplished as antennas or antenna arrays described above with references to FIG. 1-10.

The disclosed antenna system for remote sensing of buried object can be used for different application. For example, said antenna system can be used for remote sensing of mineral deposits, which involves also remote scanning of the formations hidden in highly conductive adjacent medium, using low frequencies. In geological survey applications, compact low-frequency transmitting antenna with wide frequency range of scanning (10 Hz-1 MHz) allow for a remote sensing and spectral analysis of both shallow and deep mineral deposits without a need for bore holes drilling.

Present invention offers an advantage of using a compact low-frequency transmitting antennas of an enhanced directivity gain as high as 12 dB if used as a single unit with a variable wave-compressing parameter within the encapsulation, which allows for the complete 360 deg angular scanning option in both azimuthal and polar planes. The measurements can be performed either from the surface or an air-born vehicle. FDTD simulations at 50 MHz and 500 KHz clearly demonstrate the advantage of the enhanced skin depth at the lower frequency, which is 0.8 m and 7.1 m, respectively, for the surrounding adjacent formations which average conductivity is 0.01 S/m. Therefore, lowering frequency from 50 MHz to 500 kHz increases the range of transparency for the electromagnetic waves by an order of magnitude, thus diminishing the absorption in the adjacent regions, before the reflection from the mineral ore interface such as Ni—Cu—Pt (average conductivity 0.1 S/m) takes place. The amplitude of the reflection is determined by the relative variation of the square root of the dielectric constant across the boundary and does not depend on frequency. An important conclusion of the simulations is that a complete 3D reconstruction of the geological formation can be performed remotely using the reflection mode method. The transmitting antenna operating frequency lowered to 50 kHz leads to a skin depth of 23 m, in many cases long enough to use the transmission method as well, which can be combined with the reflection method and performed at the same time, if additional receiving antennas can be moved around the region of interest.

Said system for remote sensing can be used in a reflecting mode, a diffraction mode or a transmission mode, or their combination.

For example, the low-frequency transmitting antenna comprises insulated antenna conductor in the form of circular loop having antenna conductor diameter of 1 mm and the loop radius R=0.05 mm. The transmission line has impedance 3 Ohm. The encapsulation is performed in the form of cylinder and has an external part with a relative external part permeability $\mu_{ext}$=1, the relative external part permittivity $\in_{ext}$=1 and the encapsulation conductivity $\sigma_{ext}$=0.125 S/m. The radius of the encapsulation R=0.075 m, height h=0.5 m. The receiving antenna represents circular ring with radius R=0.1 m which is centered in the same plane as the transmitting antenna. The input frequency is in the range from 100 KHz to 50 MHz, where 50 MHz is taken as the lowest resonant frequency. A detectable material is gold having conductivity $\sigma$=0.1 S/m, relative permittivity $\in$=10 and relative permeability $\mu$=1.

The low-frequency transmitting antenna radiates the electromagnetic wave to the region of the investigation. The electromagnetic wave propagates through the outer medium up to the deposit formation and then reflects from this formation. Reflected electromagnetic wave propagates to the low frequency receiving antenna which receives this electromagnetic wave.

The result of the investigation confirms high sensitivity of the received signal to the cross-sectional area of the deposit formation in the plane perpendicular to the line of sight from the stand point of the transmitting antenna. Voltage V versus cross-sectional area A [$m^2$] make up V=0.03/(A0.6+0.2) [V]. Furthermore, detectable dependence of the received signal on the distance x [m] between the geological formation and the receiving antenna is established as $V=0.1*x^{0.045}$ [V]. Considerable angular differential variation of the received radiation field $|\Delta E/E|$ in presence of the geological formation is demonstrated at the level of up to 40%. Uniform geological formation around the geological formation (Fe2S pyrite) is assumed as a reference.

Remote sensing of the hidden objects can be done from the surface or an air-born vehicle using the radar reflection mode method, similar to the one described above as the remote sensing of the geological formations. The method is effective if the boundary of the object offers a gradient of the electromagnetic wave impedance sqrt[$\mu/(\in+|\sigma/\omega)$] high enough for being used in the reflection mode. Because of the reduced spatial resolution at the low frequencies, due to large wavelength compared to the object size, the efficiency of the reflection mode measurements should be enhanced by an angular scanning, i.e. by moving the antenna system around the zone of investigation.

Furthermore, said antennas can be used for medical purposes, for example in magnetic hyperthermia. It is possible because frequencies less than 1 MHz not so danger to health. Further, possible irradiation has much less power. Due to large skin depth and possibility of using of diffraction, there is significantly less energy losses are appeared and a need in a large power is absent. That means that the possible health hazards associated with exposure to high-power radio waves will disappear in such antennas.

According to one embodiment of the invention, antenna system for remote energy transfer comprises low-frequency transmitting antenna radiating an electromagnetic wave and low-frequency receiving antenna receiving the electromagnetic wave radiating by the low-frequency transmitting antenna. Each of the transmitting antenna and the receiving antenna can be accomplished as antennas or antenna arrays described above with references to FIG. 1-10.

The low frequency transmitting antenna preferably arranged in a building and the low frequency receiving antenna is mounted on a mobile device. The mobile device is selected from the group of: notebooks, mobile phones, PDAs, smartphones, tablets. Further, the low frequency receiving antenna preferably mounted on an electric vehicle.

The disclosed system provides efficient long-distance wireless transmission of energy, even through Earth at low frequencies (1 KHz-10 KHz). There is no need for direct line of sight to transfer energy between transmitting antenna and receiving antenna due to enhanced level of material penetration, for example, large skin depth of order of wavelength in the surrounding medium, immune to weather conditions, low health risk even by exposure to a radiation power as high as 1 MW.

The arrays of compact powerful and of high directive gain compact transmitting antennas can be used in various energy harvesting and transmitting systems, which additionally involves a frequency converter at the location of the transmitting antenna array and the array of receiving antennas. Wireless transfer of energy does not require a broad bandwidth. In fact, higher quality factor (Q-factor) (lower bandwidth) is compatible with the more efficient power transfer at around the operational frequency.

For example, a transferring of energy is executed from Africa to Europe over the ocean. There are solar batteries accumulating solar energy located in the Africa. The amount of solar energy is over 1 GW. Solar energy is transformed by a generator to an alternate current and then to low-frequency transmitting antennas. The transmitting antennas has an operational frequency of 300 Hz, the wavelength in the air about 1000 km which implies a near field to induction zone on that spatial scale, and comprises an array of the linear transmitting antennas of a size 10 m each, and the composite textured encapsulation made of the amorphous carbon of the conductivity 3 S/m and the ferrite of the permeability 100. The ocean has the conductivity of over 4.5 S/m and acts as a waveguide for the transferred energy. The transferred energy is received by a set of the receiving antennas located in Europe each enveloped with the encapsulation made of the permeable non-conducting material such as ferrite for an enhanced receiving efficiency, the size of each elemental receiving antenna may vary depending on the circumstances and doesn't really restricted by any fundamental restrictions at low frequencies. The spread of the receiving antenna array is an inverse of the directivity of the transmitting manifold but can be made much smaller within the near field zone as there is no waste of energy due to the near field coupling.

Reduced requirements to the bandwidth makes this type of powerful and highly directive system for remote energy transfer particularly attractive for wireless transfer of energy, which can also be used for remote powering of vehicles without a need for an interrupted traffic, both on the roads and in the air.

In one embodiment, there is a net of transmitter antennas arranged cross the city or on the roads. The remote powering of vehicles is performed during movement of the vehicles on permanent basis. For example, the car will be able to go 200-250 km getting small charging stay close to each traffic light instead 150 km as now. This can be accomplished by using antenna system for energy transfer. The transmitting antenna comprises a loop conductor of a size of 1 m at an operational frequency of 300 Hz and a composite textured encapsulation made of the amorphous carbon of the conductivity 300 S/m and ferrite of the relative permeability of 100. The transmission lines input impedance is about 0.02 Ohm to provide with an enhanced transmission.

An array of receiving antennas is mounted on a vehicle. Said receiving antennas has a size of 0.1 m each and enveloped into an encapsulation made of a permeable material with a permeability of 1000 for an enhanced efficiency of the receiving in the near field zone.

In another embodiment, said antennas are used for remote charging. For example, for robots charging while moving different rooms and places splitted by walls and working from battery. Further charging application is mobile devices, for example notebooks, mobile phones.

In case of remote charging the transmitting antenna is mounted within a building and comprises a loop conductor having size of 1 m, an operational frequency of 300 Hz and is enclosed in a composite textured encapsulation made of the amorphous carbon with conductivity 300 S/m and ferrite with permeability of 100. The transmission lines input impedance is about 0.02 Ohm to provide with an enhanced transmission.

In one embodiment, the transmitting antenna comprising a solid angle, where the maximum of the radiation occurs, of a size commensurable to an angular size of the receiving antenna for higher efficiency of the radiated power.

In one embodiment, an operating frequency of the electromagnetic wave of the transmitting antenna is selected to provide a skin depth of the outer medium of at least 2.7r, wherein r is the distance between the transmitting antenna and the receiving antenna. The electromagnetic wave penetration depth in any material is characterized by the skin depth in that medium determined by the conductivity in that material, by definition, the skin depth is a distance upon which the electromagnetic wave intensity gets decreased by a factor of 2.7.

In one embodiment, the antenna system comprising a feedback connection between the transmitting antenna and the receiving antenna.

In case if the electromagnetic power is transferred via the electromagnetic radiated waves, a feedback connection between the transmitting antenna and the receiving antenna located on the recipient object might be required in order to enhance the power transfer efficiency. In its simplest form, the feedback might involve: using global positioning system (GPS) or global navigation satellite system (GLONASS) to enable 3D location of the remotely powered object and to position the transmitting antenna to align its radiation directivity lobe toward the object; a communication pair of transmitting antenna—receiving antenna positioned at the location of the power transmitting antenna, and a communication pair of transmitting antenna—receiving antenna at the location of the power receiving antenna on the object, both communication. Transmitting antenna and communication receiving antenna operating on an alternative frequency if the frequency of the power transmitting antenna is not high enough to ensure a bandwidth compatible with the delivery of the global positioning information. Other positioning or navigation methods such as active radar technology can also be used instead of the GPS or GLONASS, which would involve a radar transmitting antenna at the power transmitting antenna location additional to the power transmitting antenna.

For example, there is a net of one thousand transmitting antennas having high directivity arranged cross the city or on the roads. Each transmitting antenna has wave length of 10 kHz and power of 5 kW. Buildings have a skin depth of 15-150 m. The vehicle is provided with a receiving antenna or an antennas array. Remote powering of a vehicle can be implemented on the distance of 3 km by ten transmitting antennas nearest to the vehicle. In this case an average efficiency of the energy transferring is about 65%. The antenna system comprises a Dedicated Short-Range Communications (DSRC) which allows feedback connection between transmitting and receiving antennas. If large energy loss are occurred during energy transferring from one or more of said transmitter antennas, the DSRC disconnect the receiving antenna, mounted on the vehicle, from this one or more antennas. This provides enhanced energy transfer efficiency up to 85 percent. If the power of the remaining transmitting antennas is not sufficient for powering the vehicle, a processor unit connects other transmitting antennas with sufficient energy transfer efficiency to provide required powering. When the battery is charged, the receiving antenna is automatically disconnected.

Further, the system for remote energy transfer is used to improve vehicle security system. For example, if the vehicle is stolen, it cannot be hided in underground parking place, garage etc, because the signal from the antenna will be visible in any way. Providing a small enveloped transmitting antenna on a parked vehicle at operational frequency of 100 kHz would allow the radiated signals penetrate slabs of concrete (the electric conductivity of concrete is assumed to be 0.01 S/m) up to 16 m total thickness. Ordinary transmitting antenna of a reasonable portable size would operate at 10 MHz and higher, which limits the total thickness of the concrete slabs to 1.6 m only.

The antennas with such characteristic can be used in the earthquake zone. In case of building destruction, a location of the people can be detected inside the building, if they have such antennas located, for example, on clothes. Further, if each floor of the building is provided with sensors equipped by the antennas, it is possible to determine a degree of the destruction of the building. By providing of appliances mounted in the building with said antennas it is possible to execute remote control of said appliances, for example, remote power cutoff.

In one embodiment, the disclosed antennas used in electronic bracelets for kids, dogs, criminals, etc. In this case operational frequency of 20 kHz would provide with high level of transparency for the transmitted signals and should have no health hazard if the transmitting antenna power density is kept under 1.0 W/cm2.

In another embodiment, the disclosed antennas are used in a black box of the airplanes security system. This is preferably, particularly considering the fact the black box might end up in sea water which is conducting and less transparent to higher frequencies. For example, skin depth at 1 MHz is only 20 cm sea water, whereas at 100 Hz skin depth is 23 m.

Further, the disclosed antennas can be used for low frequency communication. Low (50 Hz-300 kHz) and medium (300 kHz-3 MHz) frequencies offer unique properties such as very stable propagation conditions and the ability to penetrate the sea and earth. Besides, use of the low-frequency transmitting antennas makes the dimensions of receiving antenna practically of no importance. This is related to the fact that at low frequencies atmospheric noise exceeds the receiving antenna internal noise, and therefore the receiving antenna output signal-to-noise power ratio is independent of antenna efficiency and size.

A fundamental difficulty in achieving efficient radiation at low frequencies is the transmitting antenna large dimensions which have to be comparable to radiation wavelength ($\lambda$) in the air. Restricting the antenna geometry to a vertical monopole of height h, the radiation efficiency drops with the ratio $(h/\lambda)2$ as the wavelength increases. Maximum efficiency is obtained if the antenna height is $h=l/4$, also providing that a good match to a low-impedance transmission line (50-$\Omega$) is achieved. For medium frequencies (MF) at 600 kHz at the radiation wavelength $\lambda$=500 m, maximum efficiency is achieved if h=125 m.

Solution to the problem is offered in the present disclosure, where the extreme wave compression in a specially designed transmitting antenna allows for a related dimensional reduction. Efficiency of radiation and broadening of the bandwidth is achieved by matching the wave impedance of the envelope material to that of outer space and the transmission lines by combination of permeable and conducting/high permittivity materials and textured structure of the envelope.

Another areas of application may include: a driver assistant systems; compact portable communication; improving connectivity in buildings, tunnels and mines; radionavigation, radiolocation; fixed and maritime mobile services; aeronautical services; broadcasting; industrial, scientific and medical application; radio astronomy.

The invention claimed is:

1. A low frequency antenna for radiating/receiving an electromagnetic wave to/from an outer medium, the antenna comprising: a feed port connectable to a transmission line;

an antenna conductor connected to the feed port; and an encapsulation at least partially surrounding the antenna conductor, wherein the encapsulation has a core part adjacent to the antenna conductor and an external part adjacent to the core part and having a periphery, wherein the core part of the encapsulation has a structure, or is made of a material, having each of an encapsulation core part relative permeability, an encapsulation core part electric conductivity and an encapsulation core part relative permittivity invariable within the core part, wherein the external part of the encapsulation has a structure, or is made of a material, having an encapsulation external part relative permeability, an encapsulation external part electric conductivity and an encapsulation external part relative permittivity, wherein each of the encapsulation external part relative permittivity and the encapsulation external part relative permittivity increases continuously or step-wise on one side of the core part in the direction from the periphery of the external part of the encapsulation to the core part, and increases continuously or step-wise on the opposite side of the core part in the direction from the core part to the periphery of the external part of the encapsulation, wherein the structure or material of the external part of the encapsulation is chosen to provide a ratio of the encapsulation external part relative permeability to the encapsulation external part relative permittivity which is invariable within the external part of the encapsulation and equal to a ratio of the outer medium relative permeability to the outer medium relative permittivity.

2. The antenna of claim 1, wherein each of the encapsulation external part relative permeability and the encapsulation external part relative permittivity increases continuously.

3. The antenna of claim 1, wherein each of the encapsulation external part relative permeability and the encapsulation external part relative permittivity increases step-wise.

4. The antenna of claim 1, wherein the encapsulation external part relative permeability increases by a factor of 5-20.

5. The antenna of claim 1, wherein the encapsulation external part relative permittivity increases by a factor of 5-20.

6. The antenna of claim 1, wherein the encapsulation external part electric conductivity increases by a factor of 5-20.

7. The antenna of claim 1, wherein the encapsulation external part relative permeability varies in the range of 5-10 times that of the core part, and a ratio of the parameters including the encapsulation external part relative permittivity, the encapsulation external part relative permeability and the encapsulation external part electric conductivity is kept equal to that in the core part.

8. The antenna of claim 1, wherein the encapsulation external part relative permittivity varies in the range of 5-10 times of that not the core, and a ratio of the parameters including the encapsulation external part relative permittivity, the encapsulation external part relative permeability and the encapsulation external part electric conductivity is kept equal to that in the core part.

9. The antenna of claim 1, wherein the encapsulation external part electric conductivity varies in the range of 5-10 times that of the core part, increasing continuously or step-wise on one side of the core part in the direction from the periphery of the external part of the encapsulation to the core part, and increasing continuously or step-wise on the opposite side of the core part in the direction from the core part to the periphery of the external part of the encapsulation, and wherein a ratio of the parameters including the encapsulation external part relative permittivity, the encapsulation external part relative permeability and the encapsulation external part electric conductivity is kept equal to that in the core part.

10. The antenna of claim 1, wherein the core part has an extension that is more than one-fourth of the length of the antenna conductor.

11. An array of antennas comprising a plurality of low-frequency antennas for radiating/receiving an electromagnetic wave to/from an outer medium and a coupling arrangement between said plurality of low-frequency antennas, wherein each antenna of the plurality of the low-frequency antennas comprises: a feed port connectable to a transmission line; an antenna conductor connected to the feed port; and an encapsulation at least partially surrounding the antenna conductor, wherein the encapsulation has a core part adjacent to the antenna conductor and an external part adjacent to the core part and having a periphery, wherein the core part of the encapsulation has a structure or is made of a material having each of an encapsulation core part relative permeability, an encapsulation core part electric conductivity and an encapsulation core part relative permittivity invariable within the core part, wherein the external part of the encapsulation has a structure or is made of a material, having an encapsulation external part relative permeability, an encapsulation external part electric conductivity and an encapsulation external part relative permittivity, wherein each of the encapsulation external part relative permittivity and the encapsulation external part relative permeability increases continuously or step-wise on one side of the core part in the direction from the periphery of the external part of the encapsulation to the core part, and increases continuously or stepwise on the opposite side of the core part in the direction from the core part to the periphery of the external part of the encapsulation, wherein the structure or material of the external part of the encapsulation is chosen to provide a ratio of the encapsulation external part relative permeability to the encapsulation external part relative permittivity which is invariable within the external part of the encapsulation and equal to a ratio of the outer medium relative permeability to the outer medium relative permittivity.

12. The array of claim 11, configured as one-dimensional antenna array.

13. The array of claim 11, configured as two-dimensional antenna array.

14. The array of claim 11, further comprising a plurality of individual phases for each antenna.

15. A low frequency antenna for radiating/receiving an electromagnetic wave, the antenna comprising: a feed port connectable to a transmission line; an antenna conductor connected to the feed port; and an encapsulation at least partially surrounding the antenna conductor, wherein the encapsulation has an encapsulation relative permeability, an encapsulation electric conductivity and an encapsulation relative permittivity, wherein the encapsulation comprises a plurality of alternating first areas and second areas, wherein each first area is characterized by a first area relative permeability, a first area electric conductivity and a first area relative permittivity; each second area is characterized by a second area relative permeability, a second area electric conductivity and a second area relative permittivity; and each of the first area relative permeability, the first area electric conductivity and the first area relative permittivity is higher than each of the second area relative permeability, the second area electric conductivity and the second area relative permittivity, respectively, and wherein a ratio of the first area relative permeability to the first area relative permittivity is invariable and equal to a ratio of the second area relative permeability to the second area relative permittivity.

16. The antenna of claim 15, wherein an extension of each second area is no more than 1/10L, wherein L is a length of the antenna conductor.

17. The antenna of claim 15, wherein each second area is air.

* * * * *